US007025238B2

(12) United States Patent
Hughes et al.

(10) Patent No.: US 7,025,238 B2
(45) Date of Patent: Apr. 11, 2006

(54) QUICK RELEASE IMPLEMENT HOLDER

(76) Inventors: Jerry Hughes, 607 N. Townes Ct., Spartanburg, SC (US); George Davis, 268 Grayson Dr., Rutherfordton, NC (US) 28139-2100

( * ) Notice: Subject to any disclaimer, the term of this patent is extended or adjusted under 35 U.S.C. 154(b) by 491 days.

(21) Appl. No.: 10/460,827

(22) Filed: Jun. 12, 2003

(65) Prior Publication Data

US 2006/0022007 A1 Feb. 2, 2006

Related U.S. Application Data

(63) Continuation-in-part of application No. 09/961,775, filed on Sep. 18, 2001, now abandoned.

(51) Int. Cl.
*F42B 39/00* (2006.01)
*F41C 33/02* (2006.01)

(52) U.S. Cl. ..... 224/671; 224/914; 224/196; 224/241; 224/245; 224/931; 206/3

(58) Field of Classification Search ..... 224/671, 224/196, 199, 242, 914, 239, 240, 241, 931, 224/236, 247; 206/3, 384
See application file for complete search history.

(56) References Cited

U.S. PATENT DOCUMENTS

| | | | | | |
|---|---|---|---|---|---|
| 988,485 | A * | 4/1911 | Mitchell | 224/186 |
| 1,147,856 | A * | 7/1915 | Gilchrist | 248/145.6 |
| 2,763,411 | A * | 9/1956 | Werner | 224/199 |
| 2,837,259 | A * | 6/1958 | Blanchard | 224/199 |
| 5,477,999 | A * | 12/1995 | Blankenship, Jr. | 224/666 |
| 5,562,238 | A * | 10/1996 | White | 224/237 |
| 5,711,468 | A * | 1/1998 | Shoemaker | 224/251 |
| 6,048,014 | A * | 4/2000 | Stefanik | 294/99.1 |
| 6,050,464 | A * | 4/2000 | Ramsey et al. | 224/196 |
| 6,145,654 | A * | 11/2000 | Loghman | 206/37 |
| 6,202,908 | B1 * | 3/2001 | Groover | 224/239 |

* cited by examiner

*Primary Examiner*—Nathan J. Newhouse
*Assistant Examiner*—Justin M. Larson
(74) *Attorney, Agent, or Firm*—J. Herbert O'Toole; Nexsen Pruet, LLC

(57) ABSTRACT

A system for carrying and rapidly accessing implements carried on a belt, especially implements used by law enforcement officers. The system uses a hinged floor carried on a flatplate having a belt loop. The hinged floor is held perpendicular to the flat plate by a strap or cover having a quick-release latch at the top. When the strap or cover is released the floor drops to form an angle with the flat plate, allowing the user to quickly remove the implement using one hand.

10 Claims, 14 Drawing Sheets

QUICK RELEASE IMPLEMENT HOLDER

This application is a continuation-in-part of U.S. application Ser. No. 09/961,775 filed 18 Sep. 2001, now abandoned.

BACKGROUND OF THE INVENTION

Police officers have seen great changes in their equipment in recent years, with but one constant problem. They struggle most times with the removal of the equipment from the belts and placing them into action in a quick and easy fashion. This invention relates generally to an easy and quick access to the items held on a police officer's belt, more particularly to the non-lethal weapons and ammunition clips, but not limited to these in anyway. Hereinafter the term officer refers to a police officer.

BACKGROUND AND PRIOR ART

The modern police officer carries a variety of implements that reflect new technologies and new policing philosophies. The police officer of a generation ago wore a belt having a holster for a 0.38 caliber revolver, a ring to carry his hand-carved espontoon and a loop to carry handcuffs. Today the belt is used to carry a variety of devices, including a semiautomatic pistol, an additional ammunition magazine, an expandable "ASP®" tactical baton (an extendable baton, usually in three sections, available in various lengths and made by Armament Systems and Procedures, Appleton, Wis.), a flashlight and a pepper spray canister in addition to handcuffs and a radio. The magazine, baton, flashlight and pepper spray must be readily accessible with one hand when needed, but otherwise securely mounted.

Since police departments converted from the traditional espontoon to the ASP® baton, numerous designs have been put forward for holstering the baton.

U.S. Pat. No. 5,104,076 is directed to a reconfigurable article holder formed from strips of hook and loop material (Velcro™).

U.S. Pat. No. 5,217,151 discloses a belt mountable scabbard having a "front pocket" having an open top and a closed bottom for holding a baton in the closed position and a "back pocket" for holding a baton in the extended position.

U.S. Pat. No. 5,263,619 is directed to a tubular holder for a telescoping baton characterized by a shoulder ring into which the outer baton section seats in either the folded or open positions.

U.S. Pat. No. 5,551,610 is directed to a holster for a truncheon having a handle grip and a cross guard characterized by a clamshell shape swivally mounted on a belt so that the elongated staff of the truncheon may be worn upwardly or downwardly depending whether the police office is seated or standing.

U.S. Pat. No. 5,647,591 describes a pin and socket bayonet-type connection mechanism for connecting police accessories to an ASP® baton but does not disclose use of the connection mechanism for attaching the accessories to a belt.

U.S. Pat. No. 5,699,943 discloses a belt-mounted flashlight holder using a flexible moveable jaw and cradle which can be rotated to several detented positions and allows for a breakaway when jerked strongly.

U.S. Pat. No. 5,839,630 discloses a holster for a "side-handled" baton which has a cradle for the side handle and a shaft cradle. Snap and hook and loop fasteners secure holding tabs projecting vertically above the side handle.

U.S. Pat. No. 5,906,303 is addressed to a ring-type baton holder having a resilient coating to hold the baton in place.

U.S. Pat. No. 5,947,352 describes a baton holder of the scabbard type which attaches to belt and suspenders and allows the wearer to release the baton with a single upward hand motion.

U.S. Pat. No. 6,267,279 describes a holster for elongated hand weapons using a standardized track structure in the holster and complimentary slides on opposite faces of the device to be holstered.

Armament System and Procedures Inc. also sells a snap out flexible holster for their baton which is a slotted tapered tubular carrier sold under the name ASP Sidebreak Holster.

BRIEF SUMMARY OF INVENTION

Rapid Access Technology (R.A.T.), as it relates to weapons and items carried on the belt of an officer or into a combat situation, enhances the need and ability to quickly and easily bring weapons, such as ASP® baton or pepper spray containers into action, or the ability to insert an ammunition clip into an automatic pistol using only (if need be) one hand with no loss of speed or control of the weapon. Other commonly used items such as flashlight and handcuffs can also be carried using this system.

R.A.T. works on the need to keep these items secure until the weapon or ammunition clip is needed. When the officer unlatches the holder, the R.A.T. activates the carrier allowing gravity or spring assist to swing down pulling a locking hinge into position where it rests at an angle of 20–600. The item inside is held in place by a slip fitting, a dovetail, or any other locking device to allow easy retrieval of the needed item. A different holder may be used for each item.

Using R.A.T. for the reloading of the automatic pistol, the office unlatches the ammunition clip holder latch and the drop bottom swings down (this can also be pushed outward with a spring), pulling the locking hinge into place at an angle just away from the body. After expelling the used clip the officer aligns his weapon over the fresh ammunition clip and slams it into his weapon, pushing forward or backward to release the clip without the need to first remove the ammunition clip from his belt or turn over the new clip. The ammunition clip is held in a base down position. The access attachment holds the ammunition clip securely while allowing for the handle of the weapon to slide over the ammunition clip until it locks into place. This arrangement can be used by both left or right handed officers. When used for the other items, ASP® baton and the pepper spray container, the R.A.T. carrier holds the items securely and when engaged, the items are held at an angle where the officer can grasp, hold the item and place it into action in a fraction of the time from case holders used today and/or described in the prior art described supra.

Profile of R.A.T. carrier, which can be made of many materials and shapes depending on what holder is being used, will have a metal or plastic backing plate with an angled lock on the hinge where the back will stop the hinged floor at an angled position. The hinged floor, also made of metal or plastic, with a connection means attached to the floor, holds the item in the carrier until the officer removes it. A latch strap or cover is wrapped around the item holding it in a secure position in a normal manner. When the latch is released the weight of the held item uses gravity or a spring assist to fall and pulls the floor down until its stop hits the backing plate which will hold it at the angle needed to allow access to the items.

DETAILED DESCRIPTION OF THE INVENTION

The invention is directed to systems which secure weapons and other accessory items to an officer's belt and which allow rapid, singe-handed access to those weapons and accessory items. The rapid access technology, R.A.T., uses systems for attaching items to the belt which allows for interchangeability of items in the same holder and which are adaptable to both left and right-handed persons.

As it relates to the weapons and items carried on the belt of an officer or into a combat situation where the need and ability to quickly and easily bring weapons, such as but not limited to ASP® baton or pepper spray canister, into action, or the ability to insert an ammunition clip into an automatic pistol using only one hand with no loss of speed or control of the weapon.

When closed, the system keeps these items secure until the weapon or ammunition clip is needed. When the officer unlatches the holder, R.A.T. activates. The carrier allows gravity or spring assist to cause the holder to swing down pulling a locking hinge into position where it rests at an angle between 20–60 degrees to the vertical. The item inside is held in place by a quick release attachment means to allow easy retrieval of the item the officer needs. A different holder is used for each item based on its shape.

Figure 1:
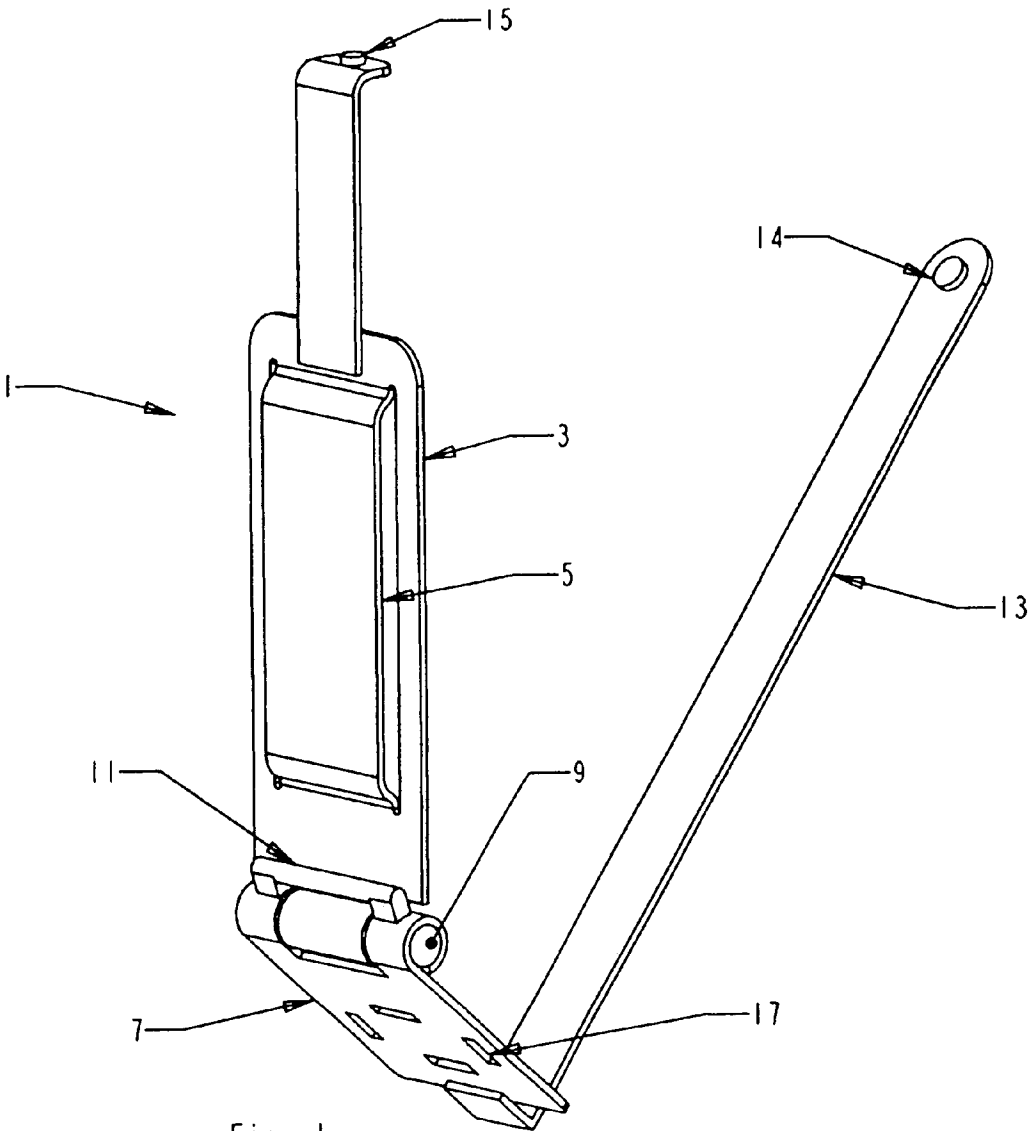
FIG. 1 shows the carrier in perspective view in the partially opened position.

FIG. 1 illustrates the basic components of the R.A.T. system. The carrier 1 consists of a substantially flat, stiff rectangular plate 3 with a belt loop 5 for attachment to a standard service belt. A rectangular floor 7 is attached to plate 3 using a hinge 9. A stop 11 limits the free rotation of floor 7. Attached to the floor 7 at the end away from hinge 9 is strap 13 which is formed from a semi-rigid material. At the end of strap 13 is an attachment means 14 which co-operates with latch 15 to hold the strap 13 securely to the plate 3 until released. In the embodiment shown, a plurality of slots 17 are present in floor 7 as one means for providing attaching means or holders for securing accessories to the floor of the device.

Figure 2:
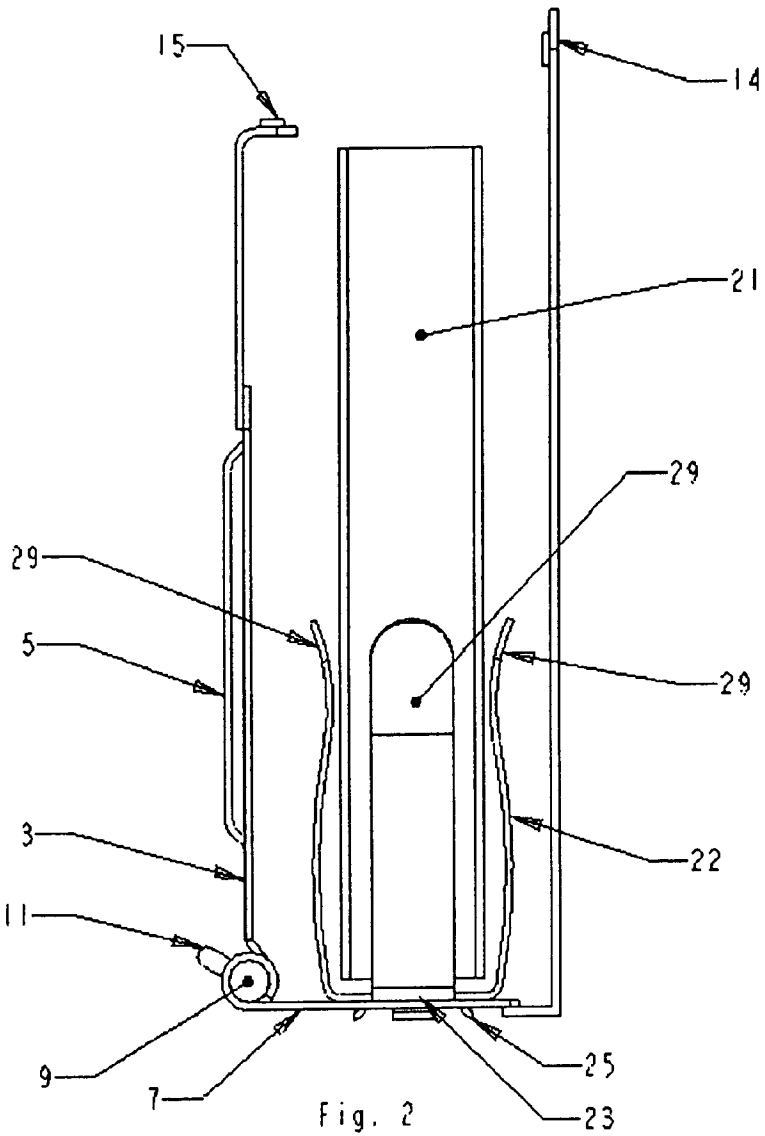
FIG. 2 shows the carrier in cross-section in the closed position holding an ammunition clip.

FIG. 2 illustrates the carrier in the closed position with the latch opened. In this illustration, an ammunition clip 21 is inserted into a holder 22. The holder has a base 23 which is attached to floor 7 using prongs 25 inserted into slots 17. A plurality of spring loaded clasps holds the clip 21 in place. Element 27 represents clasps for the broader side of the clip; element 29 represents the clasps for the front and rear of the clip which has a rectangular plan view.

Figure 3:
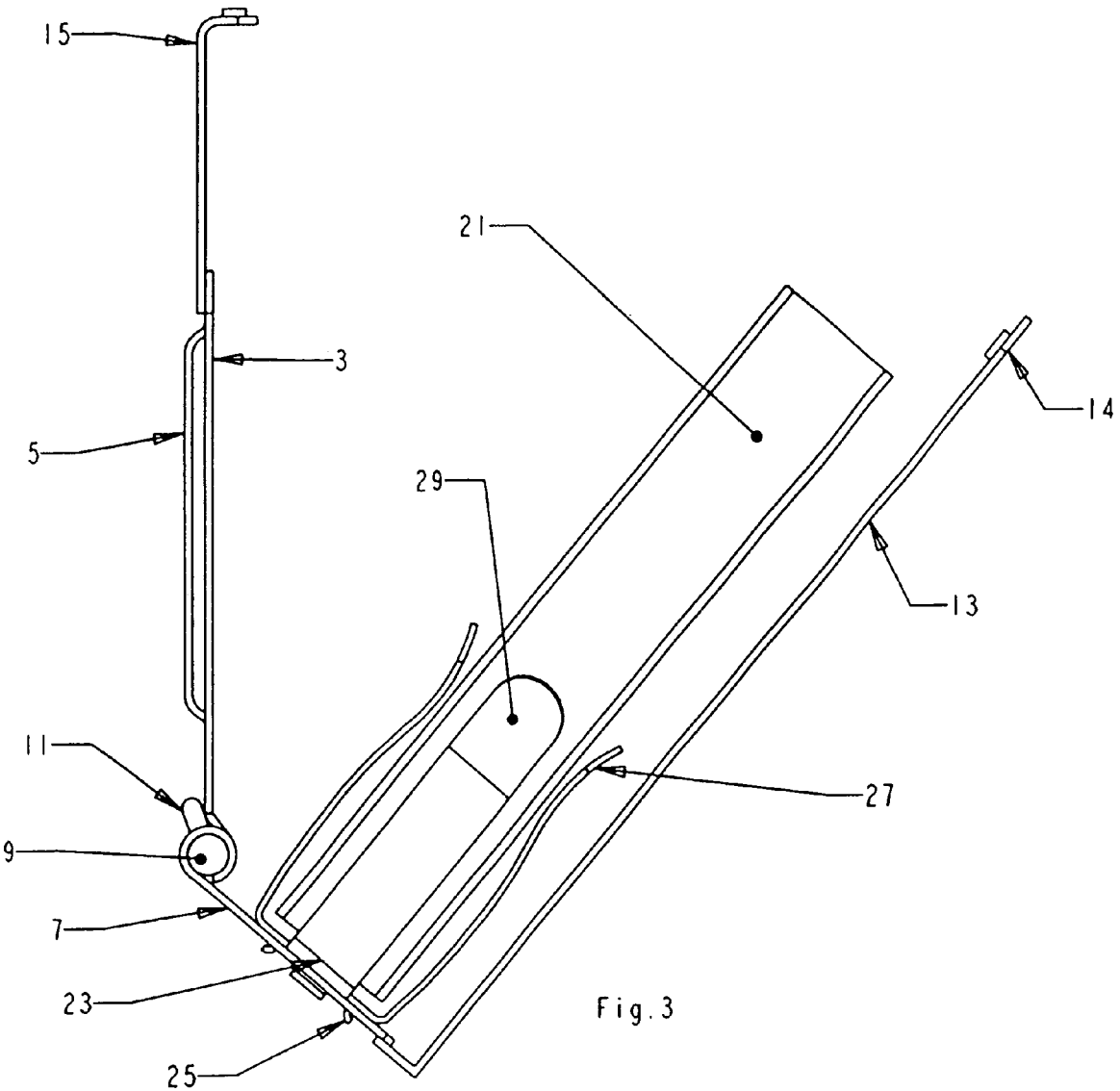
FIG. 3 shows the carrier in cross-section in the opened position.
Figure 4:
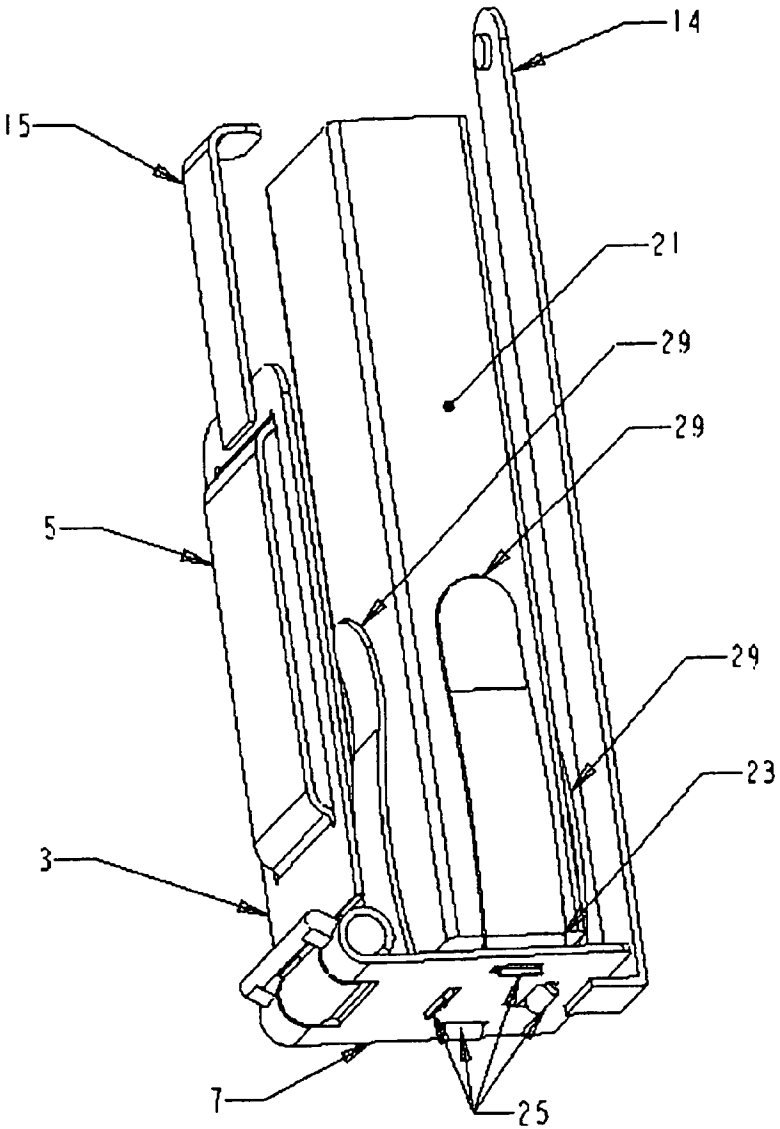
FIG. 4 shows details of the clip holder attached to the carrier.

FIG. 3 is a side elevation of the carrier of FIG. 2 in the open position. FIG. 4 is a perspective view of the carrier of FIG. 2 in the closed position showing the attachment of base 23 to floor 7 using prongs 25 inserted through slots 17.

Figure 5:
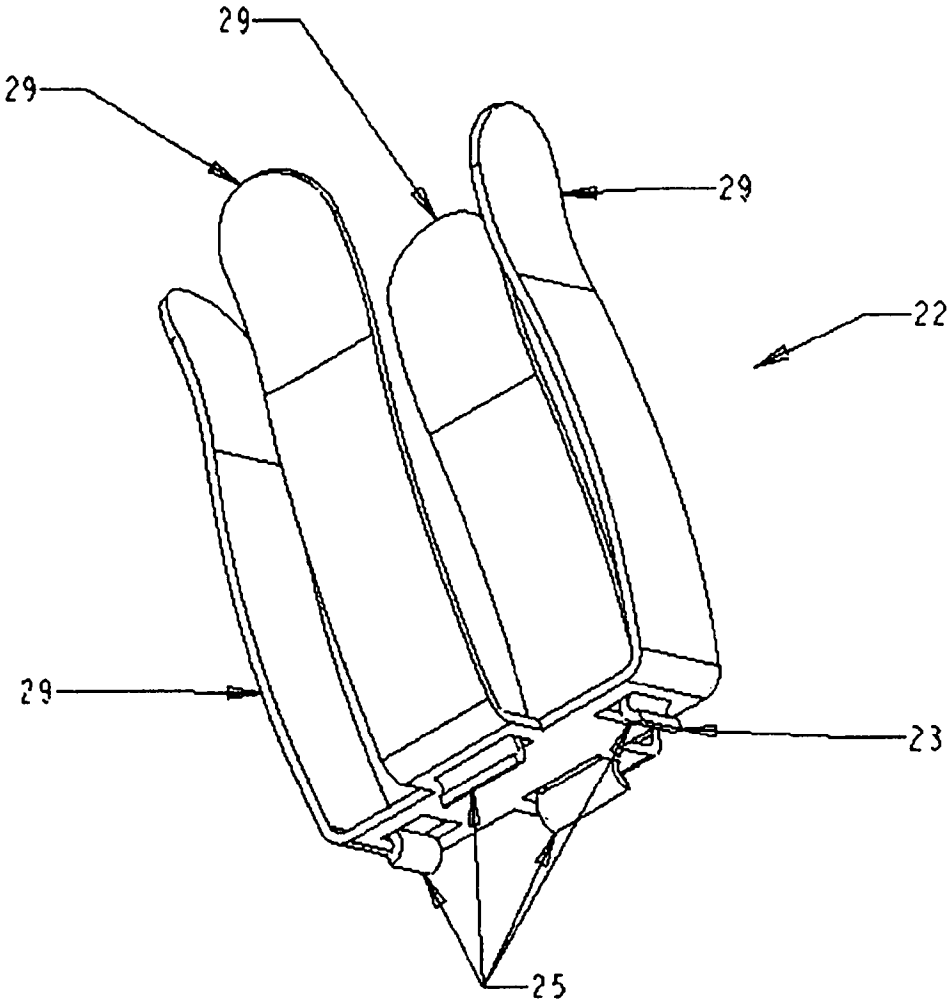
FIG. 5 shows the clip holder removed from the carrier.

FIG. 5 shows the holder 22 as a separate element. The clasps 27, 29 and prong 25 must be resilient and preferably formed from spring steel or a very resilient engineering plastic.

Figure 6:
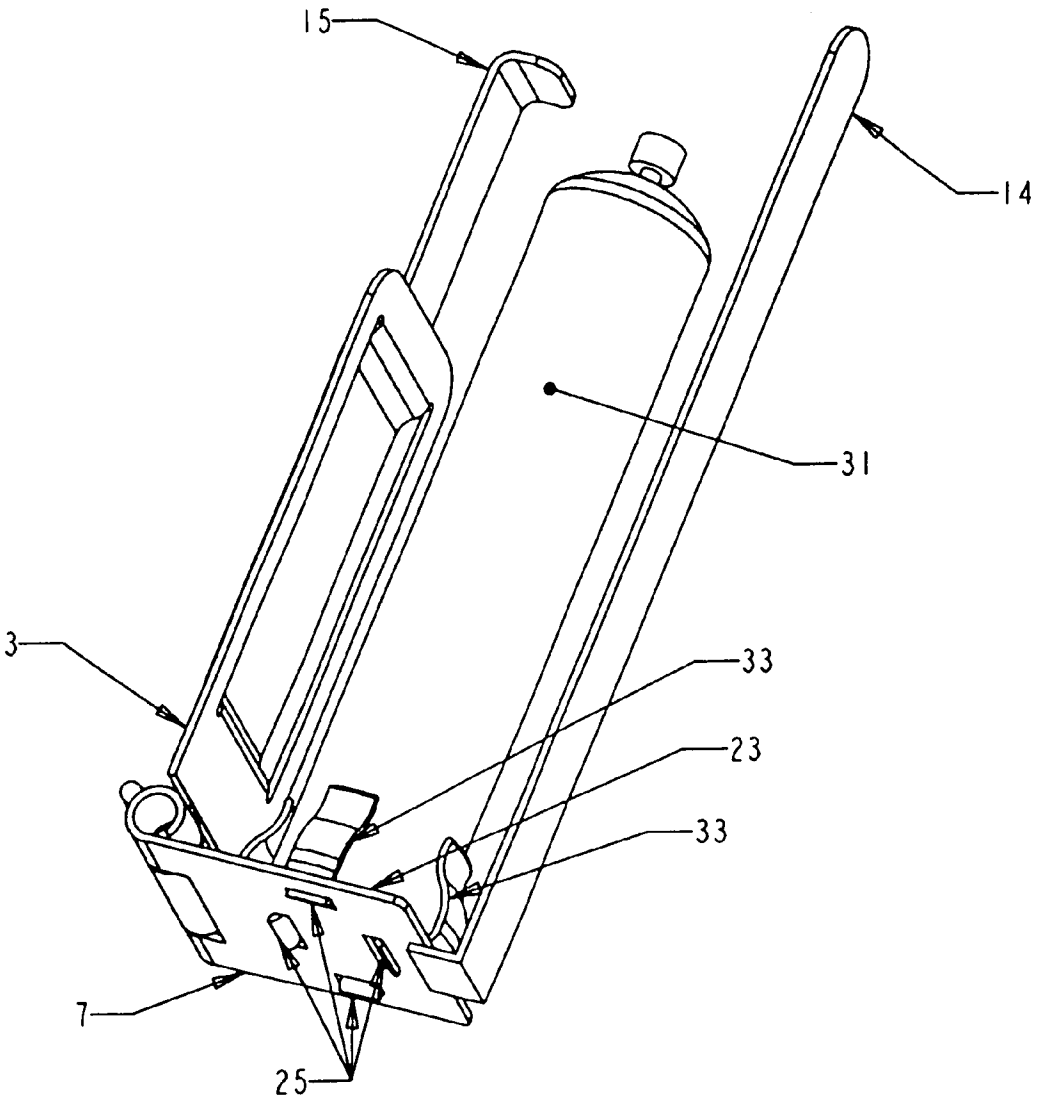
FIG. 6 shows a holder for a circular item attached to the carrier in the closed position.

FIG. 6 illustrates the use of the R.A.T. system with a cylindrical accessory such as an ASP® baton, pepper spray canister or flashlight. The cylindrical item 31 is retained in attaching means such as a base 23 having multiple clasps 33 which may be shorter than clasps 27, 29 used with a rectangular ammunition clip. Unlike the circumstance with a rectangular item such as an ammunition clip, the number of clasps needed for a cylindrical object is variable and may be from 2 to less than a complete cylinder.

Figure 7A:
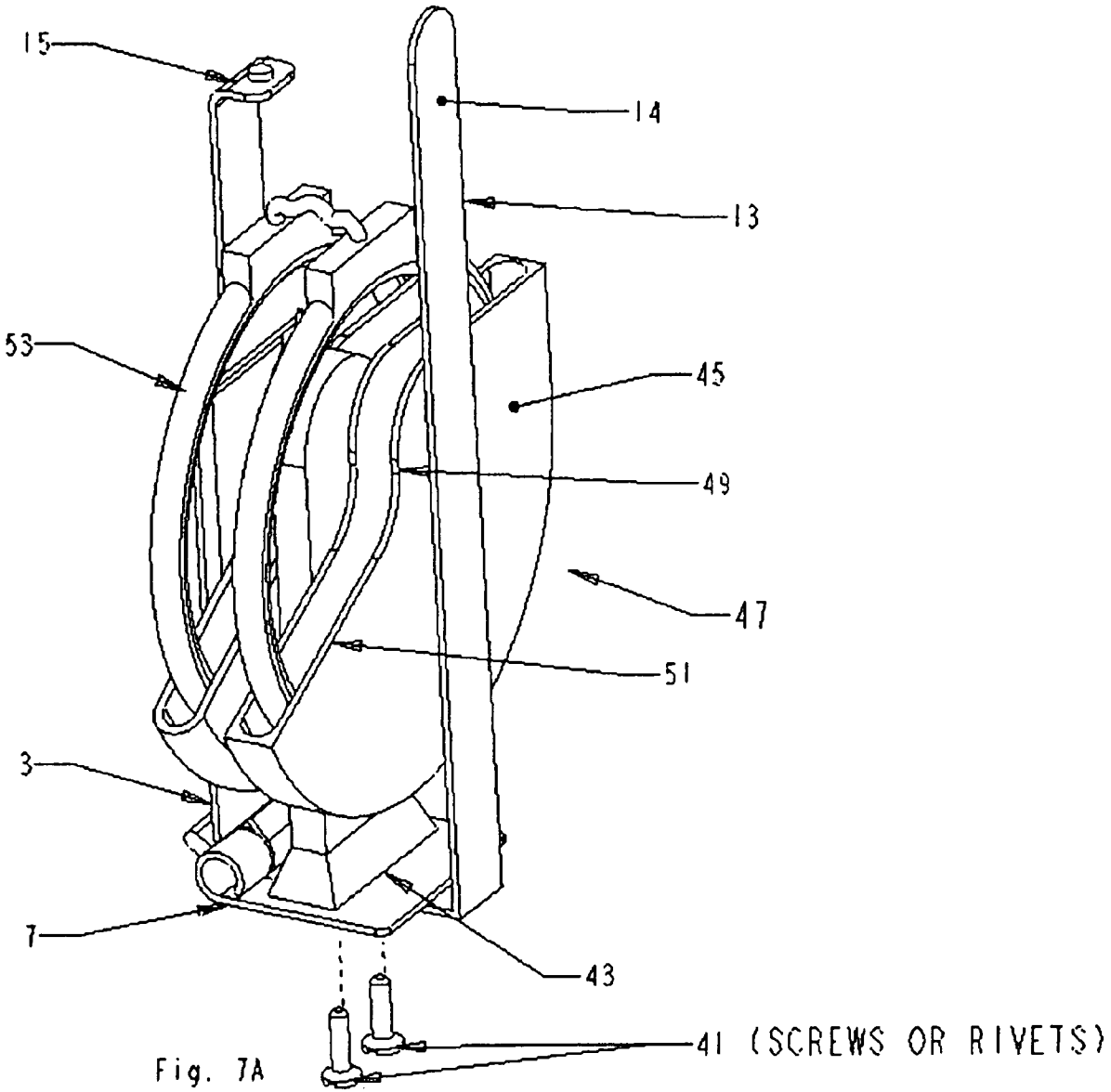
FIG. 7A shows the carrier with a holder for handcuffs.

FIG. 7A illustrates the use of the R.A.T. with an ubiquitous law enforcement item, handcuffs. A base 43 similar to holder base 23 of FIG. 5 is attached to floor 7 as in the previous drawings. Base 43 supports two cups, 45, which have a closed forward position 47 and an open rearward aspect 49. As shown in this embodiment, the base 43 is attached to floor 7 using fasteners such as screws 41 or rivets. The bottom is extended at 51 to hold handcuffs 53 in position when strap 13 is secured.

Figure 7B:
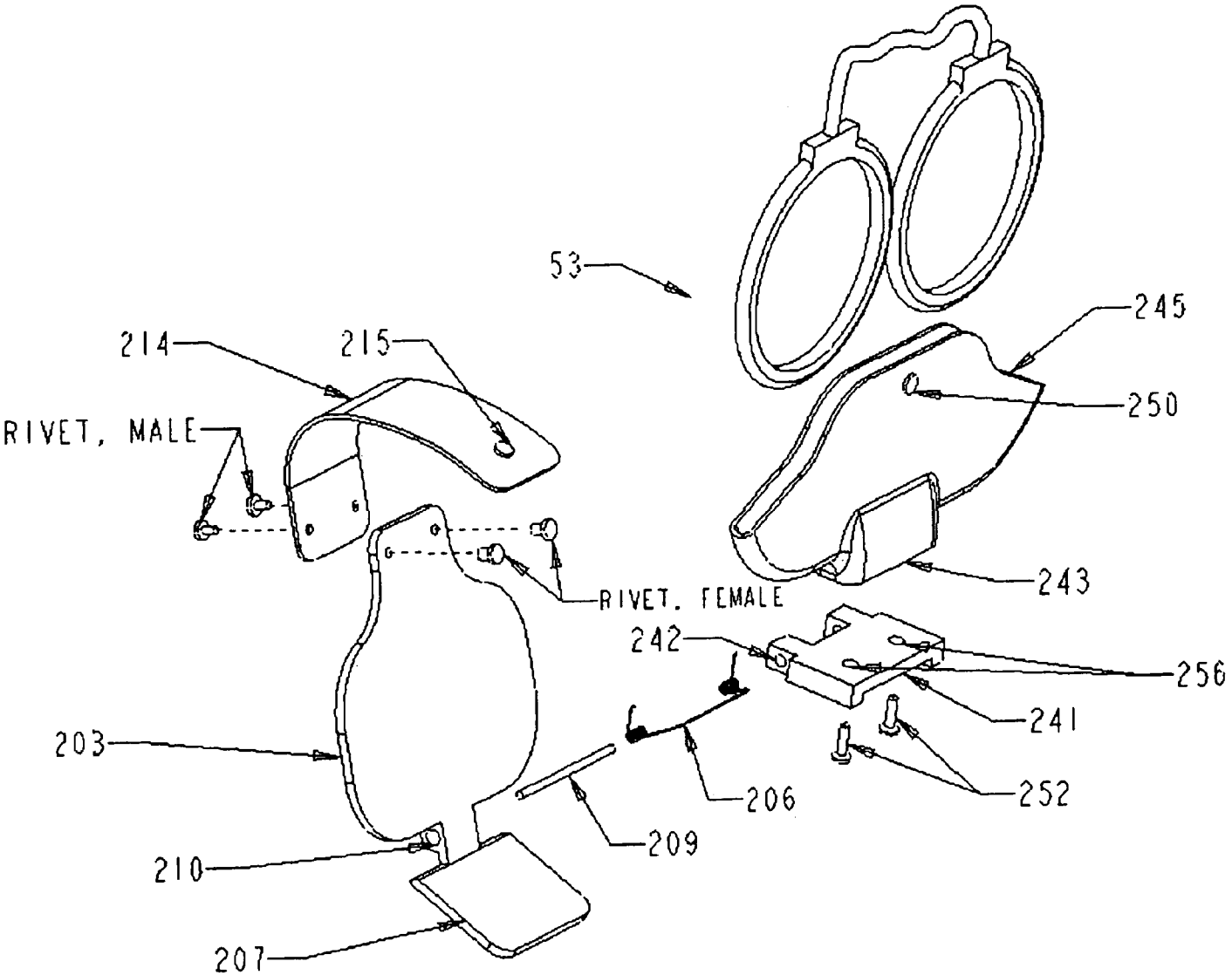
FIGS. 7B and 7C show an alternative carrier with a holder for handcuffs.
Figure 7C:
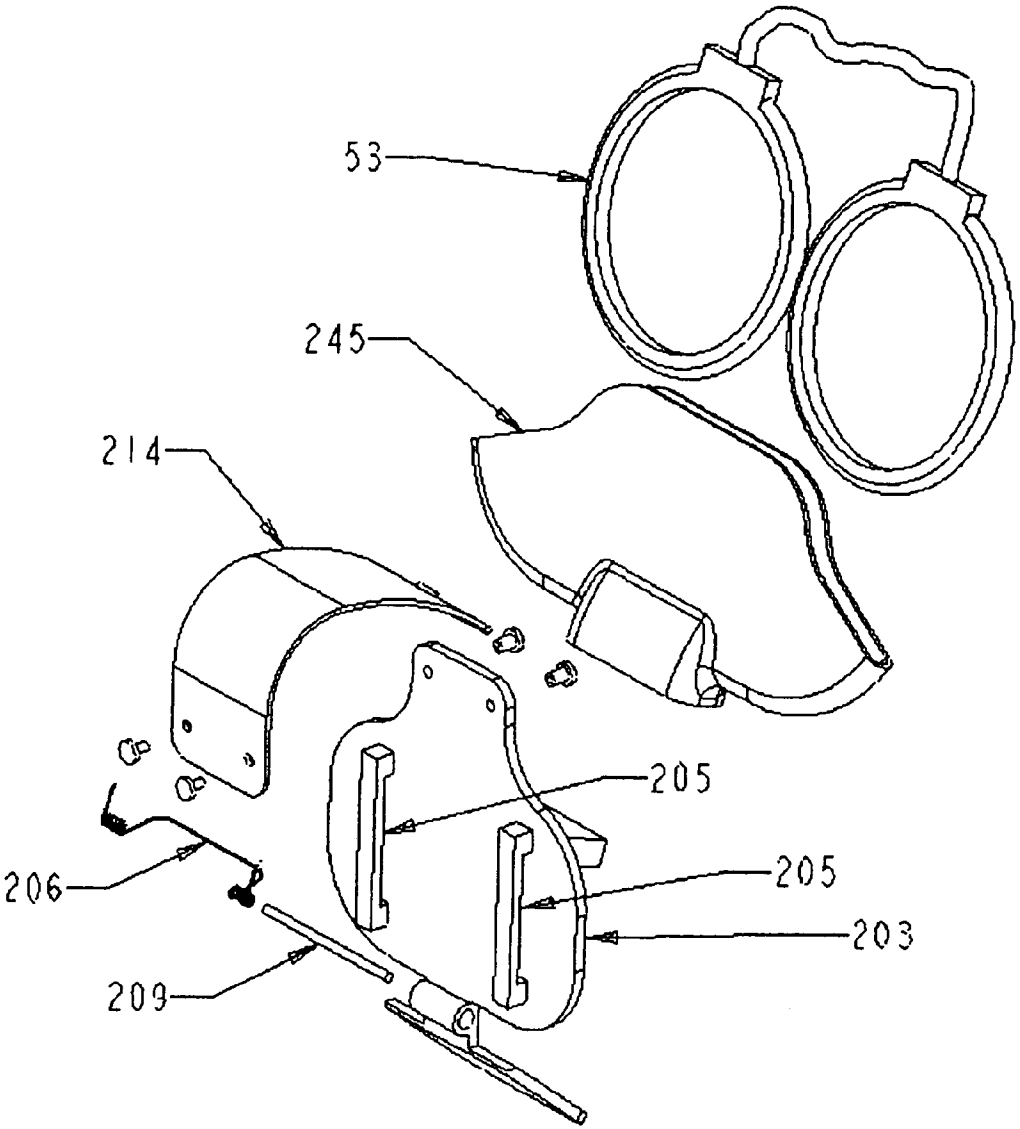

An alternative embodiment of a holder for handcuffs as shown in FIG. 7A, is shown in FIGS. 7B and 7C. Unlike the embodiment of FIG. 7A, this embodiment holds the handcuffs in linear arrangement. A flat plate 203 having belt loops 205 has a floor 207 attached mounted rigidly at an angle to serve as a stop. A base 241 is attached to flat plate 203 through a hinge pin 209 inserted through bore hole 242 and bore hole 210. Spring 206 may be used to preload base 241 away from flat plate 203. Post 243, which carries cup 245, is secured to the base 241 using screws 252 passing through untapped holes 256. Handcuffs 53 are cradled in cup 245 and held in place by strap 214 held in place on plate 203 by rivets 213 and having fastener means 215 attaching to fastener means 250.

Figure 8:
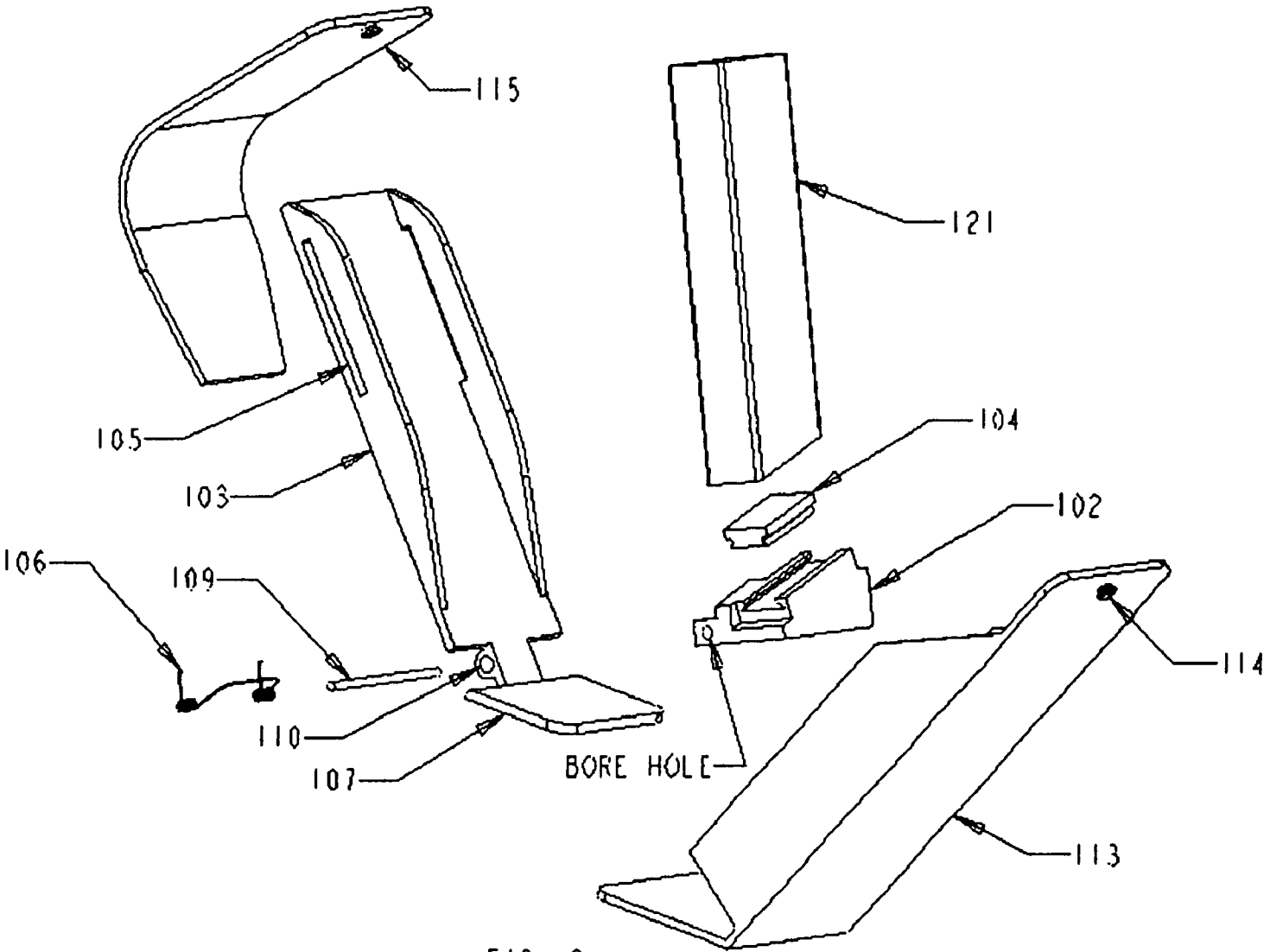
FIG. 8 shows an ammunition clip holder in exploded view according to a second embodiment of this invention.

FIG. 8 shows an alternative embodiment of the invention. In this embodiment, a dovetail connector is employed in the attaching means in lieu of clasps. The dovetail socket or dovetail pin 104 may be mounted on the implement 121 and corresponding socket or pin mounted on the holder. As shown in FIG. 8, a flat plate 103 having a belt holder 105 has a stop 107 mounted rigidly at an angle. Optionally, a spring 106 may urge the dove tail socket 102 floor to the open position. As in the previous embodiment, the stop 107 is a stop to limit the downward movement. A latch 115 and cover 113 and attachment means 114 operate as do items 13, 14, and 15 of the first embodiment.

The floor containing the dovetail socket 102 is attached to flat plate 103 through a hinge pin 109 inserted through bore hole 110 and the bore hole 210 of 102 as in the previous embodiments. As shown in FIG. 8, a dovetail pin 104 is attached to or formed into the implement such as ammunition clip 121.

Figure 9:
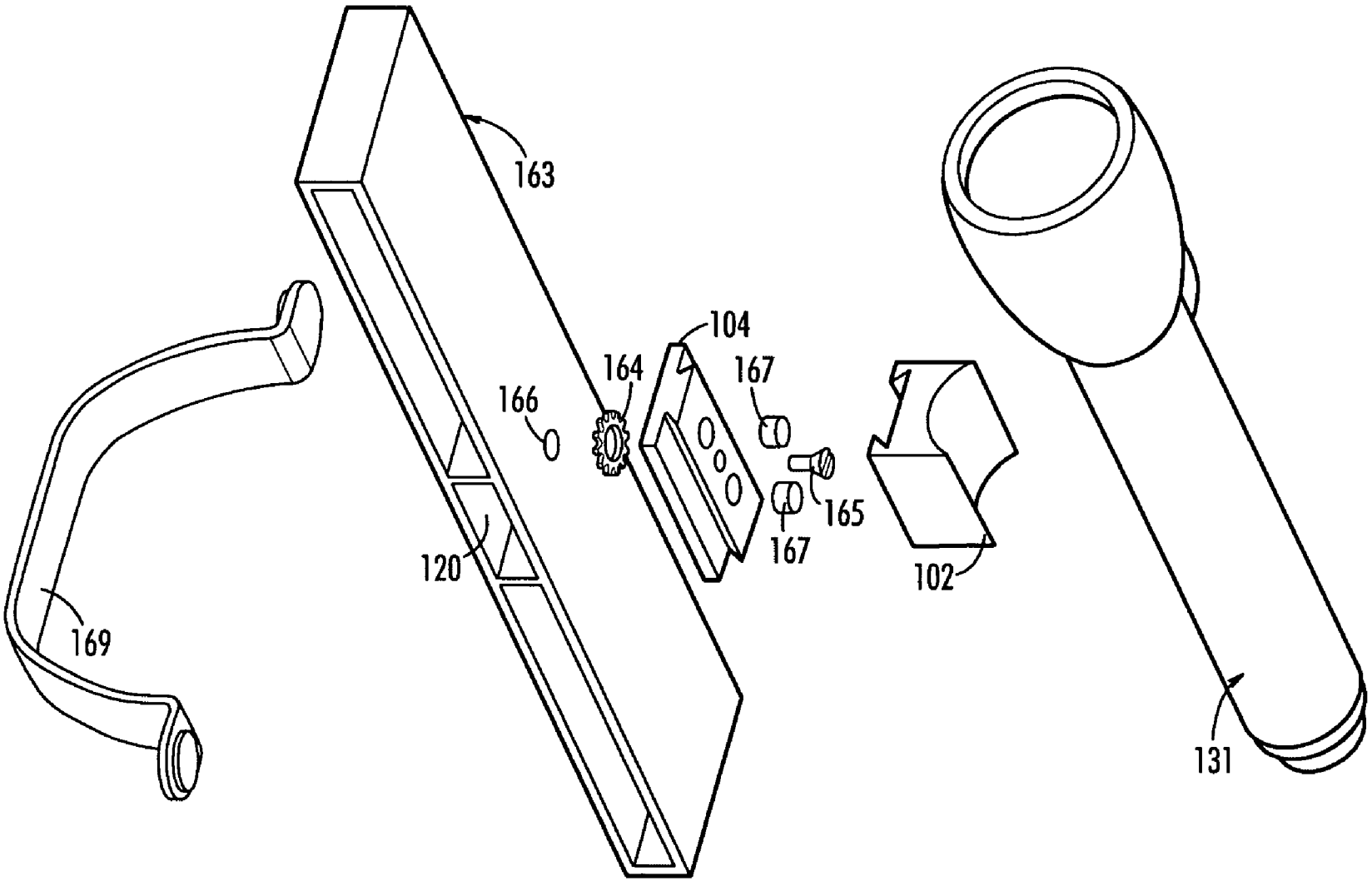
FIG. 9 shows a flashlight holder in exploded view according to a second embodiment of this invention.

FIG. 9 illustrates an adaptation to the dovetail attachment system with particular utility for a flashlight. A backing plate 163 carries a dovetail pin 104 which mates to a dovetail socket 102 which may by securely mounted to flashlight 131. A swivel pin 165 secures the dovetail pin to the backing plate 163 using socket 166. A plurality of magnets 167 may be inserted into the dovetail pin. A spring washer 164 maintains tension between pin 104 and backing plate 163 so that the flashlight may be rotated and holds in the rotated position. When the backing plate 163 is metal and/or the dovetail socket is metal, the magnets eliminate any looseness in the connection while allowing quick removal of the flashlight or rotation of the flashlights to allow no-hands lighting of an area. A strap 169 secures the backing plate 163, preferably passing through and secured to slot 120 and snapping into place.

Figure 10:
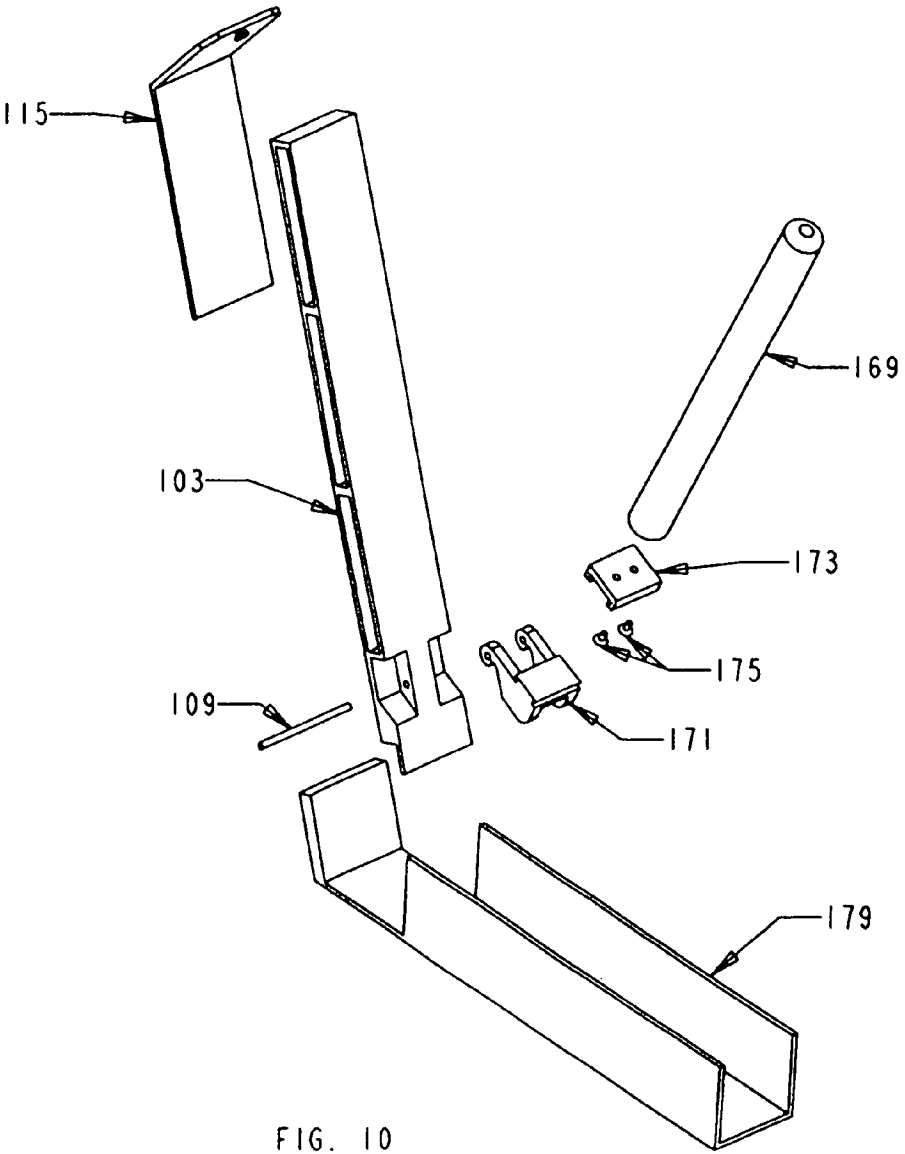
FIG. 10 shows a closed ASP® baton holder in exploded view according to a second embodiment of this invention.
Figure 11:
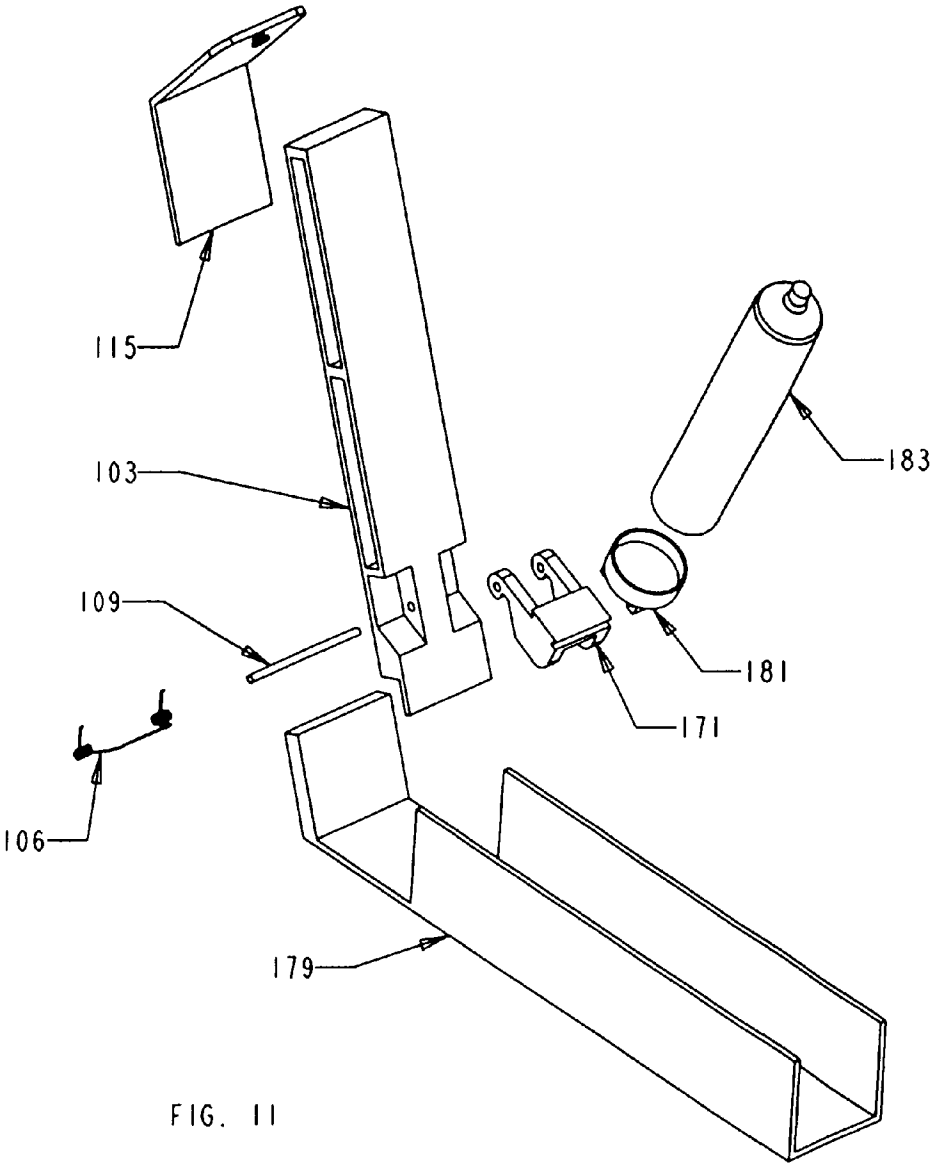
FIG. 11 shows a pepper spray canister carrier in exploded view according to a second embodiment of this invention.

FIGS. 10 and 11 illustrate an alternative use of the dovetail connection in which the dovetail pin is molded into the floor. The flat plate 103 carries a hinged floor 171 articulated at pin 109 is formed to serve as a dovetail pin. A latch 115 secures a cover 179. A dovetail socket 173 having screws 175, rivets, or made a part thereof, is secured to the implement, such as ASP® baton 169. In the case of a pepper spray canister 183, the dovetail socket may be molded into a ring mount 181.

Figure 12:
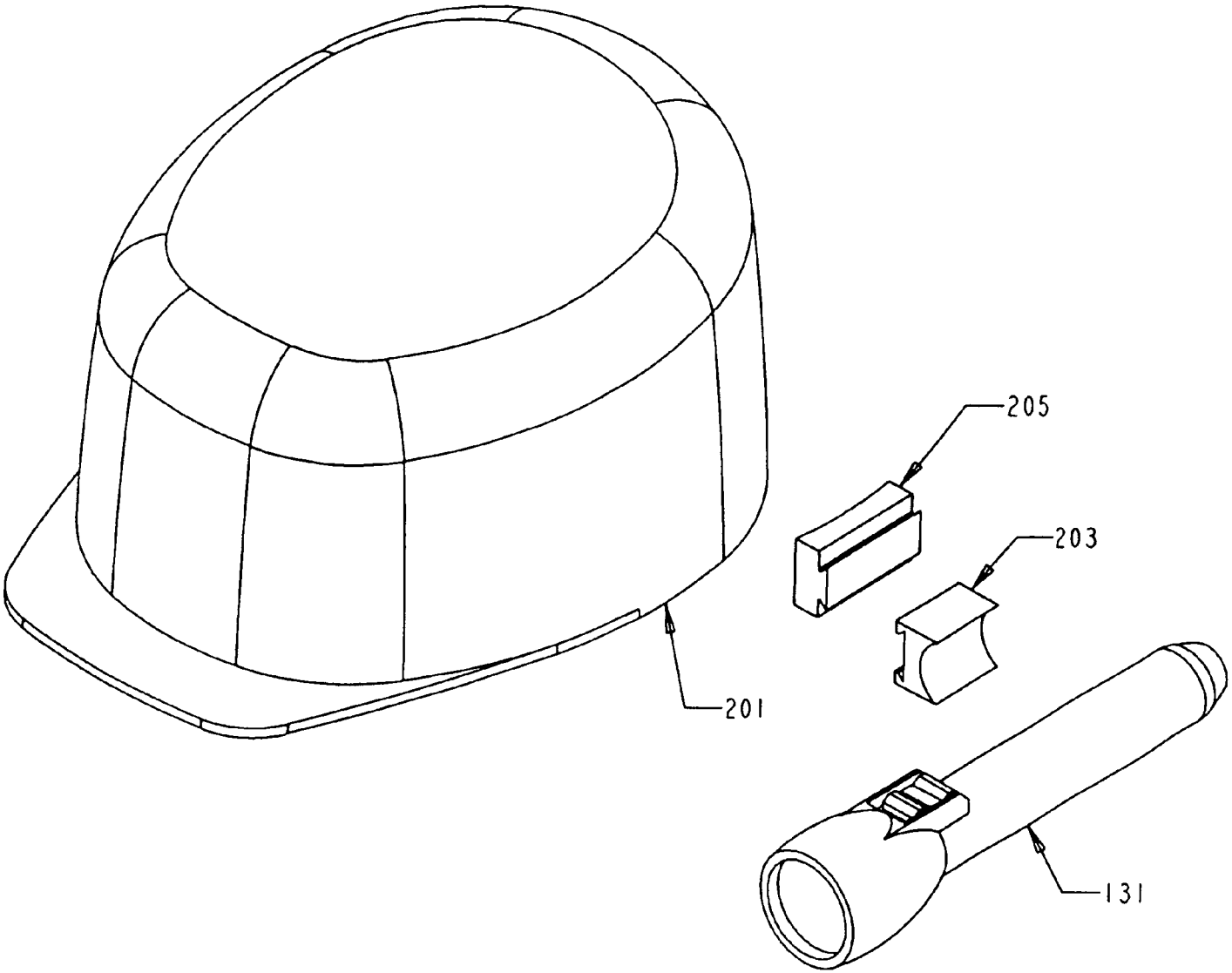
FIG. 12 shows the use of the attachment method from the second embodiment of this invention as a means for attachment of an implement on another piece of police equipment, in this case a hat.

Finally, the dovetail connection may be used with other types of police equipment. As shown in FIG. 12, a dovetail pin 205 may be mounted on a hat 201 or helmet and the dovetail socket 203 attached to flashlight 131 becomes a moveable spotlight similar to a miner's lantern. Alternatively, the socket 203 may be slid onto dovetail pin 104 at the base of an ammunition clip 121 to illuminate where a firearm is pointed.

In a further utility, the ASP® baton may be used to steady the weapon by sliding the socket 173 of the baton onto dovetail pin 104. Such an arrangement reduces fatigue in standoff situations.

In each embodiment, the implement can be accessed with one hand with a minimum of motions and quickly re-secured when no longer needed.

The flat plate 3, 103 and floor 7, 107 may be formed from a metal or an engineering plastic such as polyethylene, polypropylene, polyurethane, polyvinyl chloride and polycarbonate. The attaching means or holder should be engineering plastic. Strap 13, cover 113 and latch 15, 115 may be a flexible plastic such as polyethylene or polypropylene.

The invention has been described in terms of preferred embodiments which illustrate in a non-limiting way, the concept of the invention. Additions and modifications of the invention will be obvious to those skilled in the art and are included within the scope and spirit of the invention.

We claim:

1. A system for carrying implements on a belt comprising:
a flat plate having a loop for a belt;
a floor hinged to said flat plate at the bottom thereof;
a stop carried on said floor to limit the movement thereof;
a strap attached to said floor opposite said flat plate;
latching means to attach said strap to said flat plate;
attachment means for removeably attaching an implement; and
means for attaching said attachment means to said floor.

2. A system according to claim 1 wherein said implement is an extendable baton.

3. The system according to claim 1 wherein said implement is a flashlight.

4. The system according to claim 1 wherein said implement is an ammunition clip.

5. The system according to claim 1 wherein said implement is handcuffs.

6. The system according to claim 1 wherein said implement is a pepper spray canister.

7. The system according to claim 1 wherein said means for attaching said attachment means to said floor comprises flexible prongs.

8. A system according to claim 1 wherein said attachment means for attaching an attaching means to said floor comprises fasteners.

9. The system according to claim 1 wherein said attachment means for removeably attaching an implement to said floor comprises a dovetail connection.

10. The system according to claim 1 wherein said flat plate, floor and said attachment means for removably attaching an implement to said floor are formed from a material selected from the group consisting of metals and engineering plastics.

* * * * *